US005927160A

United States Patent [19]

Hsieh

[11] Patent Number: 5,927,160

[45] Date of Patent: Jul. 27, 1999

[54] SOCKET FOR SOCKET WRENCH

[76] Inventor: Chih-Ching Hsieh, No. 64, Lane 107, Liang Tsun Rd., Fong Yuan City, Taichung Hsien, Taiwan

[21] Appl. No.: 09/031,827

[22] Filed: Feb. 27, 1998

[51] Int. Cl.[6] ..... B25B 13/02

[52] U.S. Cl. ..... 81/125; 81/438

[58] Field of Search ..... 81/125, 438, 439

[56] References Cited

U.S. PATENT DOCUMENTS 4,919,020 4/1990 Huebschen ..... 81/125

5,249,489 10/1993 Weisman ..... 81/125 X 5,542,320 8/1996 Vasichek ..... 81/125

5,603,248 2/1997 Eggert et al. ..... 81/125 X

*Primary Examiner*—James G. Smith

*Attorney, Agent, or Firm*—Varndell Legal Group

[57] ABSTRACT

A socket for socket wrench having a magnetic bush mounted in a polygonal axial hole at one end thereof for attracting the workpiece to be turned, and a plurality of locating pins mounted in a plurality of radial holes thereof to stop the magnetic bush in place, the magnetic bush being moved axially in the polygonal axial hole between the locating pins and one end of the polygonal axial hole and having longitudinal slots which receive the locating pins.

1 Claim, 5 Drawing Sheets

SOCKET FOR SOCKET WRENCH

BACKGROUND AND SUMMARY OF THE INVENTION

The present invention relates to a socket for a socket wrench, and more particularly to such a socket which has a magnetic bush axially slidably mounted inside one end thereof and stopped between a sloping step and radial locating pins for attracting the workpiece to be turned.

A variety of socket wrenches have been developed for use with different sockets for turning different bolts and nuts. FIG. 1 shows a socket for use with a socket wrench for turning a particular bolt. This structure of socket has a magnetic bush fixedly mounted inside one end thereof by a clamp for securing the workpiece by magnetic attraction. However, this structure of socket is still not satisfactory in function. Because the magnetic bush is fixedly mounted inside the socket, it can not positively secure the workpiece in place if the workpiece is not deeply inserted into the socket. When the workpiece is removed from the machine, much effort must be employed to the socket when shaking the workpiece away from the socket.

The present invention has been accomplished to provide a socket for socket wrench which eliminates the aforesaid drawbacks. According to the present invention, the magnetic bush is slidably mounted inside the socket and stopped between a sloping step and radial locating pins. When the workpiece is inserted into the socket, the magnetic bush is moved inwards with the workpiece, and the workpiece is positively attracted by the magnetic bush. When the workpiece is removed from the machine, the socket is turned downwards, and the magnetic bush falls with the workpiece, and therefore the workpiece can be easily shaken away from the socket and the magnetic bush with less effort.

DETAILED DESCRIPTION OF THE PREFERRED EMBODIMENT

Figure 1:
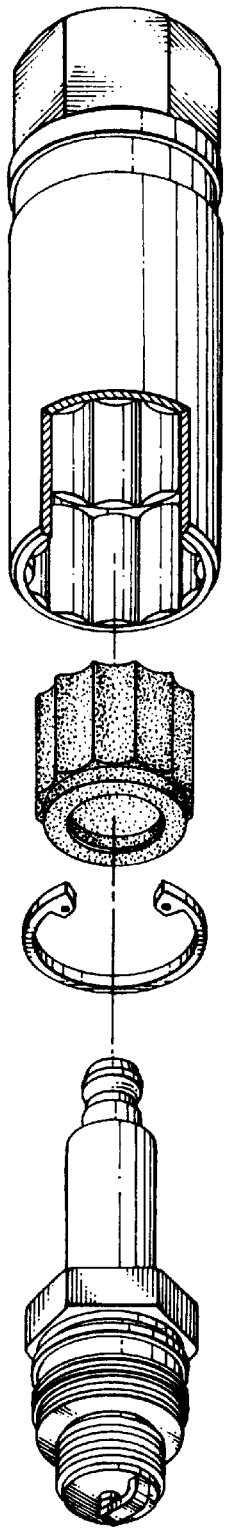
Fig. 1 PRIOR ART
FIG. 1 is an exploded view of a socket for socket wrench according to the prior art.
Figure 2:
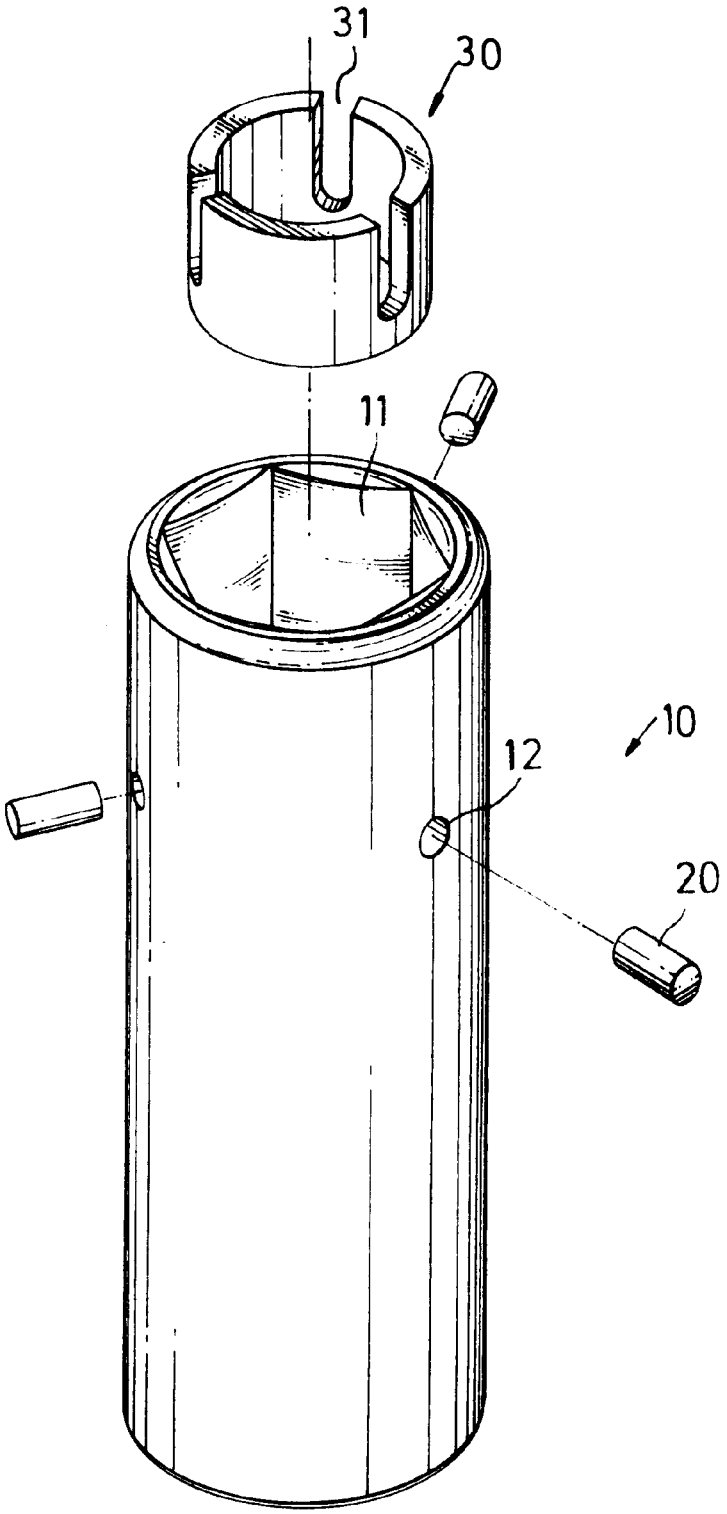
FIG. 2 is an exploded view of a socket for socket wrench according to the present invention.
Figure 4:
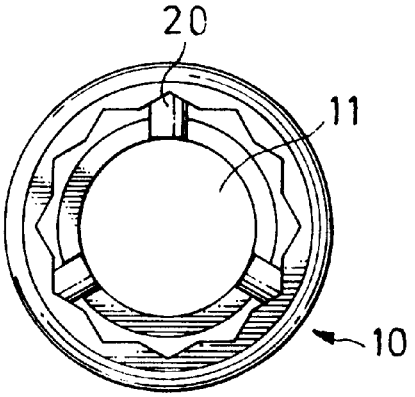
FIG. 4 is a bottom view of the socket for socket wrench according to the present invention.
Figure 3:
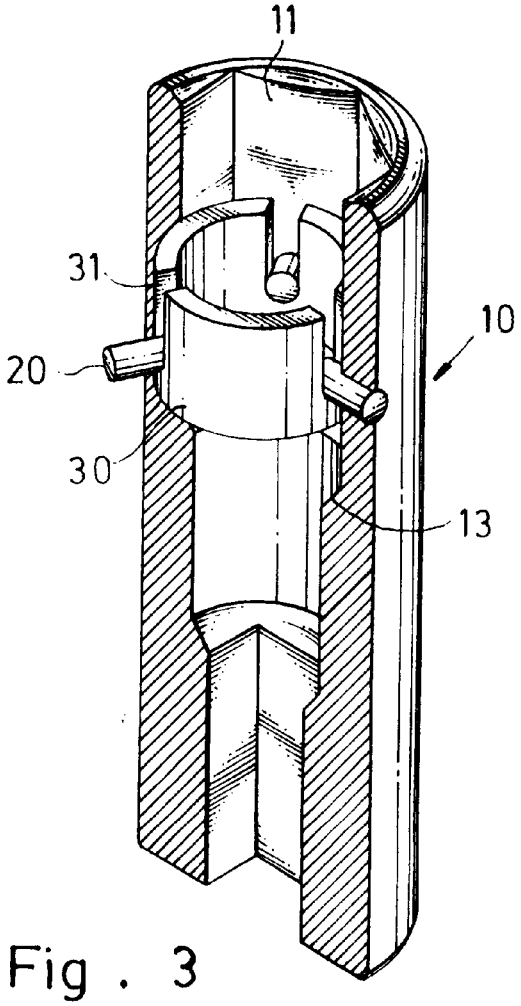
FIG. 3 is a cutaway of the socket for socket wrench according to the present invention.

Referring to FIGS. 2 and 3, the socket body 10, has a polygonal axial hole 11 at one end for receiving the workpiece to be turned (the other end of the socket 10 is for coupling to the socket wrench), a sloping step 13 around the inside wall thereof at the bottom of the polygonal axial hole 11, and a plurality of radial through holes 12 equiangularly spaced around the polygonal axial hole 11 above the sloping step 13. A magnetic bush 30 is mounted inside the polygonal axial hole 11 and secured in place by locating pins 20. The magnetic bush 30 is axially slidably mounted in the polygonal axial hole 11, having a plurality of longitudinal slots 31 extended to one end thereof corresponding to the radial through holes 12 on the socket body 10. When the magnetic bush 30 is inserted into the polygonal axial hole 11 in the socket body 10, the locating pins 20 are respectively mounted in the radial through holes 12 and perpendicularly inserted into the longitudinal slots 31 on the magnetic bush 30 with front ends thereof disposed in flush with the inside wall of the magnetic bush 30. When installed, the magnetic bush 30 is stopped inside the polygonal axial hole 11 in the socket body 10, and allowed to be moved axially between the locating pins 20 and the sloping step 13.

Figure 7:
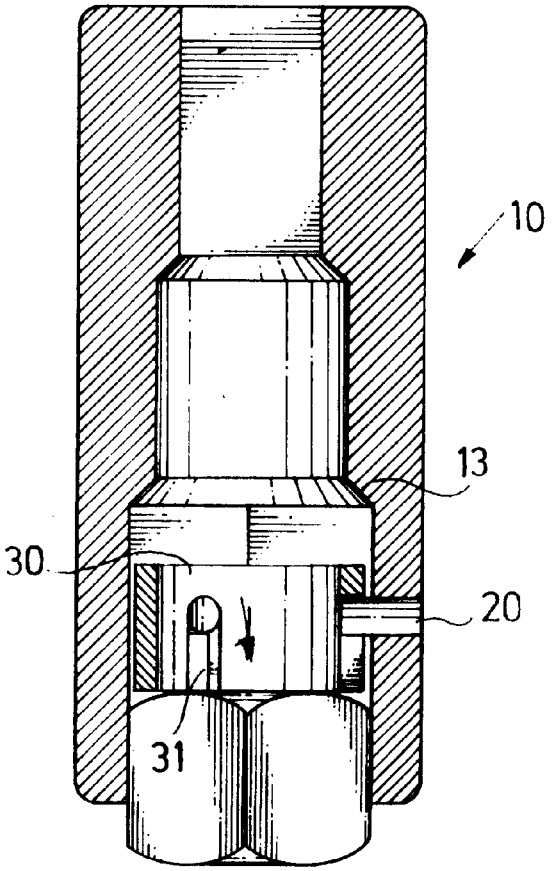
FIG. 7 is another applied view of the present invention, showing the socket body turned downwards, the magnetic bush moved outwards and stopped at the locating pins.
Figure 5:
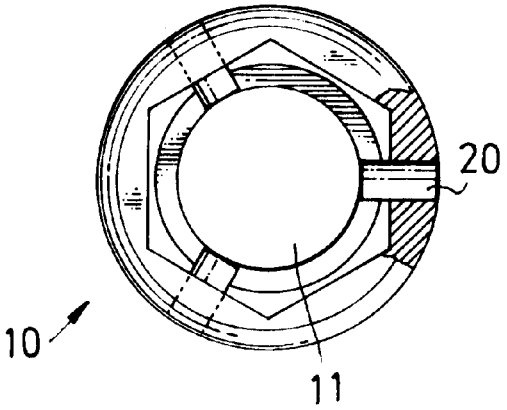
FIG. 5 is a cross sectional view of the socket for socket wrench according to the present invention.
Figure 6:
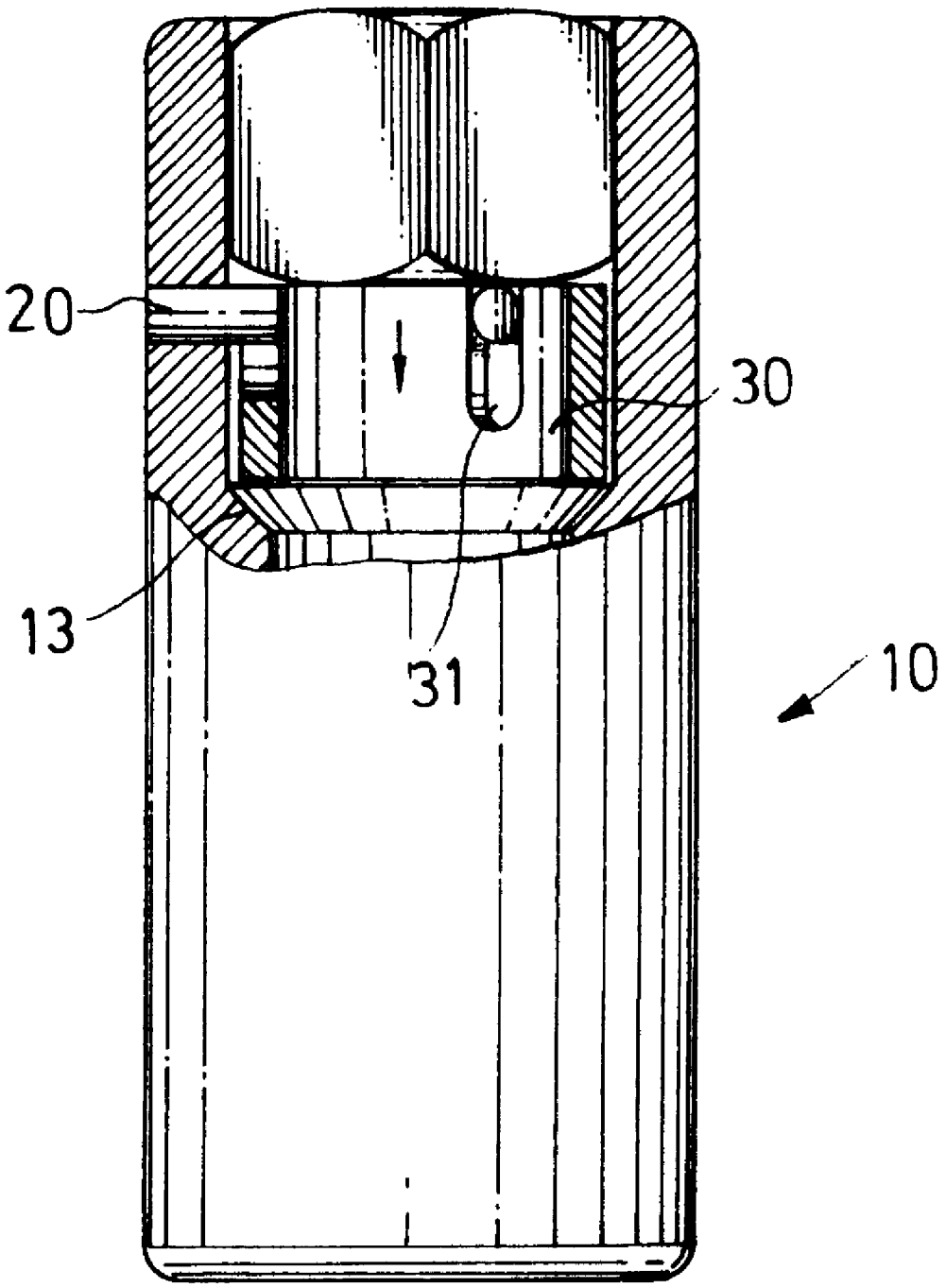
FIG. 6 is an applied view of the present invention, showing the socket body attached to the workpiece, the magnetic bush moved inwards and stopped at the sloping step, the workpiece retained to the magnetic bush.

Referring to FIGS. 6 and 7, when the socket body 10 is attached to the workpiece to be turned, the magnetic bush 30 is forced inwards by the workpiece and stopped at the sloping step 13, and the workpiece is attracted by the magnetic force of the magnetic bush 30 (see FIG. 6). After the workpiece has been removed from the machine, the socket body 10 is turned downwards enabling the magnetic bush 30 to fall from the sloping step 13 and to be stopped at the locating pins 20 (see FIG. 7), so that the workpiece can be disconnected from the magnetic bush 30 by shaking the socket body 10.

I claim:

1. A socket for socket wrench comprising a socket body having a polygonal axial hole at one end for turning a workpiece, and a magnetic bush mounted inside said polygonal axial hole in said socket body for attracting the workpiece, wherein said socket body comprises a sloping step at one end of said polygonal axial hole inside said socket body, a plurality of radial through holes equiangularly spaced around the periphery in communication with said polygonal axial hole above said sloping step, and a plurality of locating pins respectively mounted in said radial through holes and partially projecting into said polygonal axial hole; said magnetic bush is axially moved in said polygonal axial hole in said socket body between said locating pins and said sloping step, said magnetic bush having a plurality of equiangularly spaced and longitudinal extended slots which receive said locating pins respectively.

* * * * *